US009803408B2

(12) United States Patent
Timothy

(10) Patent No.: US 9,803,408 B2
(45) Date of Patent: Oct. 31, 2017

(54) ADJUSTABLE HINGE

(71) Applicant: E. Erik Timothy, Apollo Beach, FL (US)

(72) Inventor: E. Erik Timothy, Apollo Beach, FL (US)

(73) Assignee: NATIONWIDE INDUSTRIES, INC., Tampa, FL (US)

( * ) Notice: Subject to any disclaimer, the term of this patent is extended or adjusted under 35 U.S.C. 154(b) by 0 days.

(21) Appl. No.: 14/756,045

(22) Filed: Jul. 24, 2015

(65) Prior Publication Data

US 2017/0022743 A1 Jan. 26, 2017

(51) Int. Cl.
*E05F 1/12* (2006.01)
*E05D 7/00* (2006.01)

(52) U.S. Cl.
CPC ..... *E05F 1/1207* (2013.01); *E05D 7/0009* (2013.01); *E05F 1/1215* (2013.01); *E05Y 2600/10* (2013.01); *Y10T 16/53862* (2015.01)

(58) Field of Classification Search
CPC .... E05F 1/1207; E05F 1/1215; E05D 7/0009; E05D 7/0018; E05D 7/0027; Y10T 16/304; Y10T 16/5386; Y10T 16/53862; Y10T 16/538627; Y10T 16/538633; Y10T 16/2771; Y10T 16/5388; Y10T 16/53888; Y10T 16/5389; E05Y 2600/10
USPC ..... 16/50, 54, 298–301, 304, 307, 308
See application file for complete search history.

(56) References Cited

U.S. PATENT DOCUMENTS 3,825,973 A * 7/1974 Gwozdz ..... E05F 1/1215 16/300
3,898,708 A * 8/1975 Gwozdz ..... E05F 1/1215 16/301
3,965,533 A * 6/1976 Frohlich ..... E05F 1/1215 16/300
4,043,001 A * 8/1977 Parsons ..... E05F 1/1215 16/222
4,073,038 A * 2/1978 Curry ..... E05F 1/1215 16/301
4,102,013 A * 7/1978 Newlon ..... E05D 5/128 16/222
4,339,845 A * 7/1982 Newlon ..... E05F 1/1215 16/300
4,419,788 A * 12/1983 Prout ..... E05F 1/1215 16/300
5,572,768 A * 11/1996 Daul ..... E05F 1/1215 16/337
5,584,100 A * 12/1996 Doyle ..... E05F 1/1215 16/299
5,651,536 A * 7/1997 Daul ..... E05F 1/1215 16/50

(Continued)

*Primary Examiner* — William Miller

(57) ABSTRACT

An adjustable hinge for a door or gate comprising a first hinge member and a second hinge member rotatable relative to each other each including a substantially flat hinge base having at least one mounting aperture formed therethrough and a pair of spaced apart collars extending outwardly from the outer surface thereof that cooperatively form a housing and a tension adjustment assembly to selectively adjust a bias disposed within the housing having a first adjustment assembly disposed at one end thereof and a second adjustment assembly disposed at the opposite end thereof to adjust the force of the adjustable hinge from either end thereof.

22 Claims, 3 Drawing Sheets

(56) References Cited

U.S. PATENT DOCUMENTS 7,210,199 B2 * 5/2007 Clark ..... E05D 5/06 16/299
8,549,707 B2 * 10/2013 Macernis ..... E05F 1/1215 16/298
8,683,654 B2 * 4/2014 Chen ..... E05D 11/087 16/298

* cited by examiner

ADJUSTABLE HINGE

BACKGROUND OF THE INVENTION

Field of the Invention

An adjustable tension hinge for a door or gate.

Description of the Prior Art

Self-closing and self-opening gates are in common use, particularly in situations which require increased safety. In deed, it is generally mandatory to provide self-closing gates for swimming pool fences to prevent unsupervised access by small children in the event that other persons have forgotten to close the gate. Similarly, self-closing gates are often employed in households to secure stairways and other potentially hazardous areas.

Gates of this type generally include a helical spring-loaded hinge which produces a torque to bias the hinge towards the closed or open position. A problem which arises in relation to such gates is that they vary in dimension and weight, and so the spring tension in the hinge must be adjusted accordingly in order to have the gate close or open at appropriate speed.

Examples of prior art are described below.

U.S. Pat. No. 8,549,707 describes a hinge comprising a first hinge member including a body portion having a longitudinal axis about which a second hinge member is rotatable to move the hinge between an open position and a closed position. The body portion houses biasing means having an end fixed relative to the second hinge member engages an adjustment member fixed with respect to the first hinge member. The adjustment member includes a ratchet means to move the adjustment member in a first direction to increase the tension in the biasing means.

U.S. Pat. No. 5,584,100 discloses a hinge comprising a first hinge member and a second hinge member. The first hinge member comprises a cylindrical housing disposed between flange members formed on the second hinge member. A torsion spring is provided inside the cylindrical housing disposed in a recess at end of the cylindrical housing and the other end fits into a recess in a coupling element located at the other end of the cylindrical housing. The coupling element has a hexagonal engagement surface which engages a matching engagement surface in flange. By depressing the coupling element so that it is no longer in engagement with flange member, the coupling element can be turned so that its hexagonal external surface is in a different orientation with respect to the matching hexagonal surface of the flange when pressure on the coupling element is release.

US 2014/007520 shows a hinge comprising first and second hinges and coupling connecting the first and second hinge parts. The first and second hinges are rotatable relative to each other having a biasing member to impart a biasing force relative rotation of the hinge parts. The coupling comprises a first coupling portion movable to change the biasing force of the biasing member. The hinge further comprises a stop arrangement to limit the adjustment movement to thereby restrict change to the biasing force.

U.S. Pat. No. 244,185 relates to a door-spring of two leaves, a pintle having an elongated vertical recess or groove in its lower end, a ratchet-collar on the pintle and having a lug engaging the recess or groove in the latter. A stationary stop is disposed one of the hinge-leaves. The collar is connected to the coiled spring to rotate with, and slide vertically on, the pintle substantially as and for the purpose described.

U.S. Pat. No. 5,651,536 shows a door closer or hinge including an upper adjustable torsion spring/ratchet combination power to close the door and a lower adjustable rotary damper to control the door closing speed.

U.S. Pat. No. 4,073,038 discloses an adjustable tension spring to close a hinge after being rotated to an open position comprising a pair of notched ratchet-like members.

U.S. Pat. No. 8,683,654 describes an adjustable torque hinge including a torque adjustment member and spring combination. The outer end of the torque adjustment member includes a hexagonal adjustment hole to receive a hex key to adjust the torque force. The torque adjustment member can then release the torque spring to return the adjustable torque hinge to the original tension.

Australian patent 666491 describes a coupling element connected to a spring. The coupling element includes a head portion with a circular top section and a hexagonal intermediate section which engages a matching hexagonal engagement surface in an aperture of the spring housing. To adjust the spring tension, a tool is inserted into the slot and pressure is applied to disengage the coupling element so that it can be turned to a different orientation. A disadvantage of this arrangement is that it requires the simultaneous application of a linear force along the spring axis and a rotational force about the spring axis. This is a relatively unnatural movement which can cause inconvenience to the installer.

Additional examples of the prior are found in U.S. Pat. No. 244,185; U.S. Pat. No. 255,938; U.S. Pat. No. 308,337; U.S. Pat. No. 3,316,582; U.S. Pat. No. 3,735,724; U.S. Pat. No. 4,817,242; U.S. Pat. No. 5,715,574 and U.S. Pat. No. 8,160,287.

SUMMARY OF THE INVENTION

The present invention relates to a hinge to maintain a gate or door in a normally close position. As discussed hereinafter, the closing force of the hinge is adjustable and may be used on either a left or right hand gate or door.

The hinge comprises a first and second hinge member rotatably coupled by a tension adjustment assembly including a first and second adjustment assembly operatively coupled by an adjustable bias.

Each hinge member comprises a hinge plate having an outer collar including an end cap receiving channel and an inner or interior collar including a hinge pin receiving channel extending or projecting outwardly from the front face or surface thereof.

The outer and inner or interior collars overlap relative to each other to cooperatively form a housing for the first and second adjustment assembly and the adjustable bias when the outer collars and inner or interior collars are axially aligned along the longitudinal axis when the hinge is fully assembled.

The first and second adjustment assembly each comprises an end cap and a hinge pin.

Each end cap comprises a substantially cylindrical body having a first set of ratchet teeth formed on the inner end portion thereof.

Each hinge pin comprises a cap including a bias receiving recess and a pin receiving channel to receive portions of the adjustable bias described hereinafter and a second set of ratchet teeth formed on the outer end portion thereof to operatively engage the first set of ratchet teeth. A tool receiving projection including a tool receiving channel extends outwardly from each cap to selectively receive a tool to rotate one or the other of the hinge pins to adjust the tension of the adjustable bias.

The adjustable bias comprises a helical or torsion spring disposed within the bias receiving recess formed in each hinge pin having a pin extending outwardly from each end thereof to fit into the corresponding pin receiving channel formed in each hinge pin to secure or lock each helical or torsion spring rotationally relative to the cap of the corresponding hinge pin.

Each tooth of the second set of ratchet teeth of each hinge pin includes a leading face or surface that is inclined or slanged rearwardly or in a first direction; while, each tooth of the first set of ratchet teeth includes a blocking face or surface that may be inclined or slanted in a second direction such that when the upper hinge pin is rotated in a first direction, the teeth of the second set of ratchet teeth engage the teeth of the first set of ratchet teeth depressing the helical or torsion spring and more tightly winding the helical or torsion spring to increase the tension on the helical or torsion spring to increase the closing force of the hinge.

Once the desired tension or torque is reached, the tool is removed from the tool receiving channel. The leading faces or edges of the first set of ratchet teeth engage the trailing faces or edges of the second set of ratchet teeth to lock either upper adjustment assembly in position.

In other words, the teeth of the first set of ratchet teeth and the second set of ratchet teeth act as a ratchet means by allowing rotational movement of the hinge pins in one direction only (in this example, the clockwise direction).

Since the pins of the helical or torsion spring are fixed with respect to the first and second hinge members, rotational movement of the first and second hinge members with respect to each other, for example by opening a gate to which the hinge is attached, will tend to create a torsional restoring force to move or force the hinge back to the original closed position.

The direction of the door or gate closing can be reversed simply by repositioning the first and second hinge members from left to right or right to left.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE INVENTION

Typically, a gate or door hinge is configured to swing closed in a single (left to right or right to left) direction. In order to have the gate or door swing or close in the opposite direction a different gate or door hinge is required. Otherwise, the gate or door hinge may be turned upside down. This requires any spring or bias adjustment to be accomplished from the bottom of the gate or door hinge. This is generally awkward and difficult.

Figure 1:
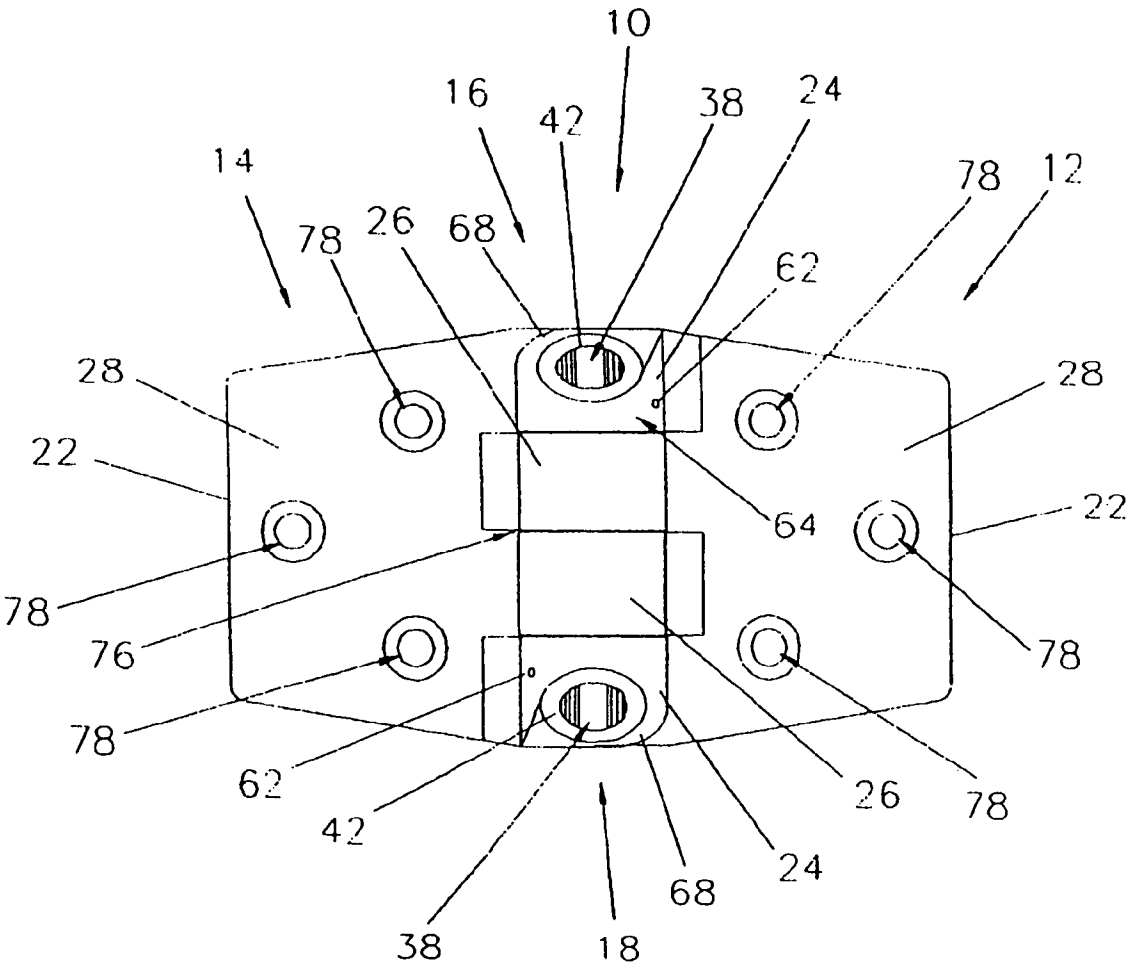
FIG. 1 is a perspective view of the adjustable tension hinge of the present invention.
Figure 2:
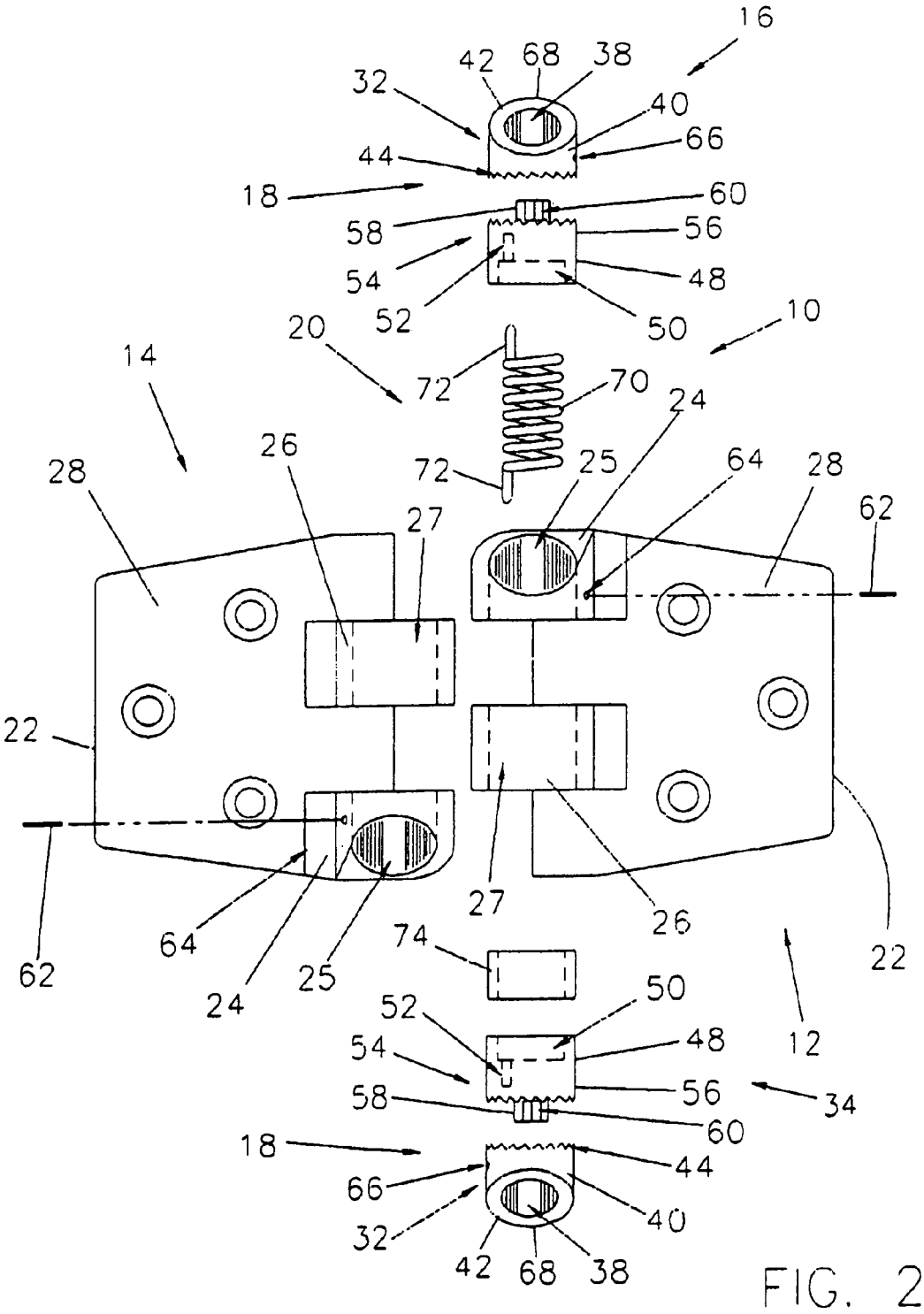
FIG. 2 is an exploded view of the adjustable tension hinge of the present invention.
Figure 3:
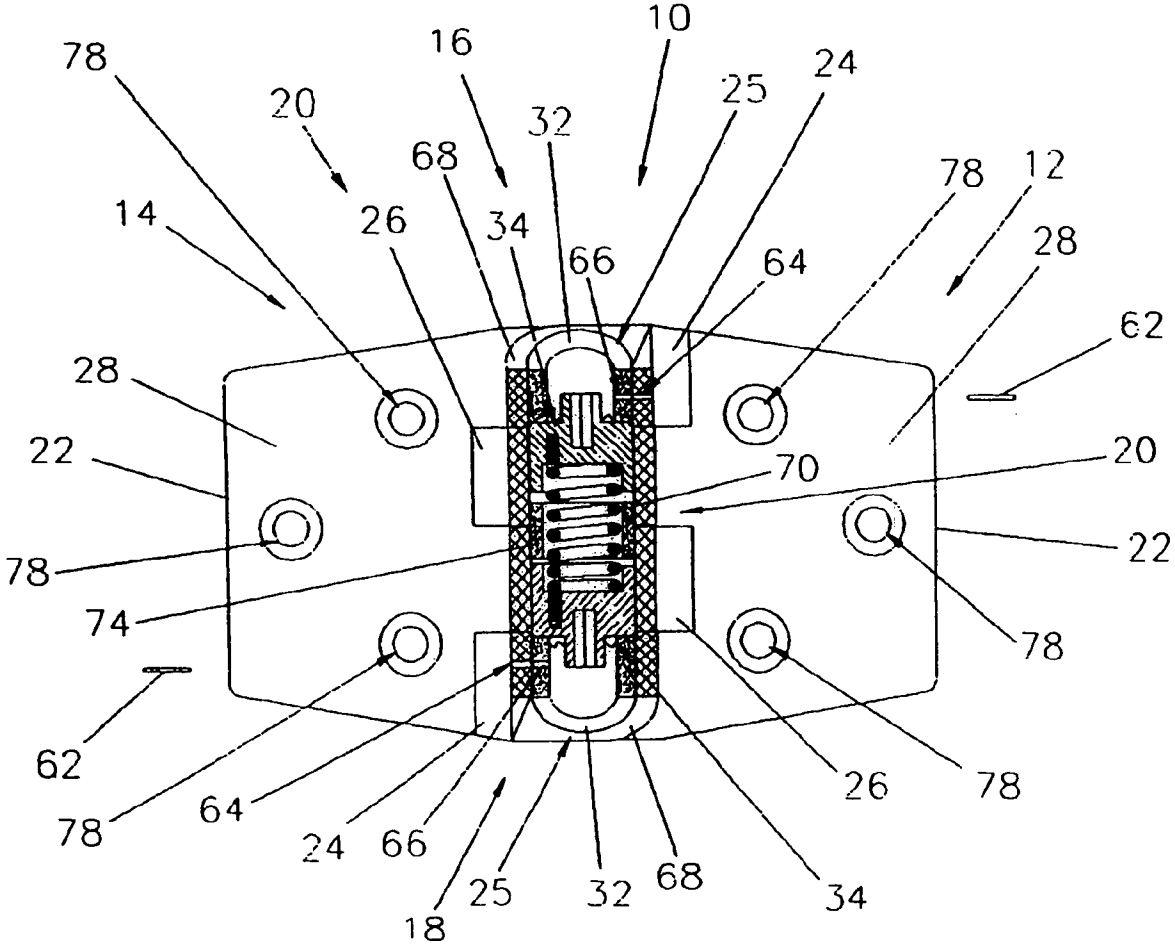
FIG. 3 is a cross-sectional view of the adjustable tension hinge of the present invention.

As shown in FIGS. 1 through 3, the present invention relates to a hinge generally indicated as 10 to maintain a gate or door (not shown) in a normally closed position. As discussed hereinafter, the closing force of the hinge 10 is adjustable for use with either a left or right hand gate or door (not shown).

The hinge 10 comprises a first hinge member generally indicated as 12 and a second hinge member generally indicated as 14 rotatably coupled by a tension adjustment assembly including a first adjustment assembly generally indicated as 16 and a second adjustment assembly generally indicated as 18 disposed at opposite ends thereof and operatively coupled by an adjustable bias generally indicated as 20.

The first hinge member 12 and the second hinge member 14 are similarly constructed. Specifically, each hinge member 12/14 comprises a substantially flat hinge plate 22 having an outer collar 24 including a centrally disposed longitudinal end cap receiving channel 25 and an inner or interior collar 26 including a centrally disposed longitudinal hinge pin receiving channel 27 extending or projecting outwardly from the front face or surface 28 thereof.

The inner or interior collar 26 of the first hinge member 12 is at least partially disposed between the outer collar 24 and inner or interior collar 26 of the second hinge member 14; while, the inner or interior collar 26 of the second hinge member 14 is at least partially disposed between the outer collar 24 and inner or interior collar 26 of the first hinge member 12 to cooperatively form a housing for the first adjustment assembly 16, the second adjustment assembly 18 and the adjustable bias 20 when the outer collars 24 and inner or interior collars 26 are axially aligned along the longitudinal axis 30 when the hinge 10 is fully assembled.

The first adjustment assembly 16 and the second adjustment assembly 18 are also similarly configured. Specifically, each comprises an end cap and a hinge pin generally indicated as 32 and 34 respectively.

Each end cap 32 comprises a substantially cylindrical body 36 having a centrally disposed longitudinal channel 38 formed therethrough. The outer end portion 40 of the substantially cylindrical body 36 has an inclined or slanted surface 42; while a first set of ratchet teeth generally indicated as 44 is formed on the inner end portion 46 of the substantially cylindrical body 36.

Each hinge pin 34 comprises cap 48 including a bias receiving recess 50 and a pin receiving channel 52 to receive portions of the adjustable bias 20 as described hereinafter and a second set of ratchet teeth generally indicated as 54 formed on the outer end portion 56 thereof to operatively engage said first set of ratchet teeth to cooperatively form a ratchet or hinge pin directional control as described hereinafter. A tool receiving projection 58 including a tool receiving channel 60 extends outwardly from the outer end portion 56 of each cap 48 to selectively receive a tool such as an Allen wrench (not shown) therein to rotate one or the other of the hinge pins 34 to adjust the tension of the adjustable bias 20 as discussed hereinafter.

When assembled, the end caps 32 are secured within the centerally disposed longitudinal end cap receiving channel 25 of the corresponding outer collar 24 by a corresponding pin 62 press fitted through a hole or channel 64 formed through the side of the corresponding outer collar 24 and seated in a recess or hole 66 formed in the corresponding end cap 32.

The end portion of each outer collar 24 has an inclined or slanted surface 68 adjacent the inclined or slanted surface of the corresponding substantially cylindrical body 36 of the corresponding end cap 32 in substantially the same diagonal plane.

As best shown in FIG. 2, the adjustable bias 20 comprises a helical or torsion spring 70 dimensioned to snuggly fit into the bias receiving recess 50 formed in each hinge pin 34 having a pin 72 extending outwardly from each end thereof to fit into the corresponding pin receiving channel 52 formed in each hinge pin 34 to secure the helical or torsion spring 70 of the adjustable bias 20 rotationally relative to the cap 48 of the corresponding hinge pin 34.

Each tooth of said second set of ratchet teeth of each hinge pin 34 includes a leading face or surface inclined or slanted in a first or rearwardly relative to the direction of rotation of the hinge pin 34 when increasing tension or torque of the helical or torsion spring 70; while, each tooth of said first set of ratchet teeth of each end cap 32 includes a trailing face or surface that may be inclined or slanted in a second direction such that when the top hinge pin 34 is rotated in the first direction the teeth of said second set of ratchet teeth glide or slip past the teeth of said first set of ratchet teeth twisting the helical or torsion spring 70 increasing the tension on the helical or torsion spring 70 to increase the closing force of the hinge 10.

As previously described, said first set of ratchet teeth and second set of ratchet teeth 54 cooperatively for a ratchet or hinge pin directional control. Specifically, when a hex key or similar tool (not shown) is placed in the tool receiving channel 60 of the tool receiving projection 58 of the corresponding hinge pin 34 and turned clockwise as indicated by the arrow on the inclined or slanted surface 42, the leading edges or faces of said second set of ratchet teeth slip or glide past said first set of ratchet teeth. Once the desired tension or torque is reached, the tool (not shown) is removed from the tool receiving channel 60. The leading faces or edges of said first set of ratchet teeth engage the trailing faces or edges of said second set of ratchet teeth to prevent counter-clockwise rotation of the hinge pin 34 to securely lock the hinge pin 34 of the upper adjustment assembly 16/18 in position.

In other words, the first set of ratchet teeth 44 and the second set of ratchet teeth 54 of the adjustment member 40 act together as a ratchet allowing rotational movement of the upper hinge pin 34 of adjustment member 40 in one direction only (in this example, the clockwise direction). To release the spring tension, the hinge pin 34 is depressed disengaging said second set of ratchet teeth from the first set of ratchet teeth 44 allowing the upper hinge pin 34 to rotate counter-clockwise causing the helical or torsion spring 70 to return to the original position.

The teeth of the first set of ratchet teeth 44 and the teeth of the second set of ratchet 54 are sized and configured to permit either hinge pin 34 to be incrementally rotated or ratcheted in the first or clockwise direction to increase the helical or torsion spring tension or incrementally ratcheted in the second or counter-clockwise direction to decrease the helical or torsion spring tension. For example, the teeth of the first set of ratchet teeth 44 and the teeth of said second set of ratchet teeth 54 may comprise substantially equally sized and substantially isosceles or equilateral triangular shapes or configurations.

Since the pins 72 of the helical or torsion spring 70 are fixed with respect to the first hinge pin member 12 and the second hinge member 14, rotational movement of the first hinge member 12 and the second hinge member 14 with respect to each other for example by opening a gate to which the hinge 10 is attached, will tend to create a torsional restoring force to move or return the hinge 10 and door or gate (not shown) to the original closed position.

A floating axial alignment hollow sleeve or spacer 74 having the bias or helical or torsion spring 70 at least partially disposed therein is slidably disposed between the caps 48 of the hinge pins 34 within the housing cooperatively formed by the outer collars 24 and inner or interior collars 26 disposed to selectively engage the adjacent inner ends of the inner or interior collars 26 as well as overlay the joint or seam 76 between the two inner or interior collars 26 regardless of which adjustment assembly 16/18 is on top. The weight of the gate or door (not shown) may create a bending movement between the inner or interior collars 26 causing the inner or interior collars 26 to become axially misaligned relative to each other. Since the floating axial alignment hollow sleeve or spacer 74 is disposed to selectively engage the adjustment inner ends of the inner or interior collars 26, the floating axial alignment hollow sleeve or spacer 74 prevents or limits the bending to maintain the axial alignment between the inner or interior collars 26 and outer collars 24. In addition, the end caps 32, the caps 48, the hinge pins 34 and the floating axial alignment spacer 74 substantially isolate the interior of the housing from the exterior environs protecting the bias or helical or torsion spring 70 from the surrounding elements.

Holes 78 to affix or fasten the hinge 10 to the gate or door (not shown) to the fence post or door jam (not shown) are formed through the substantially flat hinge plates 22 to the first hinge member 12 and the second hinge member 14.

If the hinge 10 is to be used or placed on a door or gate to swing from the opposite side of a fence or door jamb, the hinge 10 is rotated "upside" down and secured in place.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. An adjustable hinge for a door or gate comprising a first hinge member and a second hinge member rotatable relative to each other, said first hinge member and said second hinge member each comprising a hinge plate having an outer collar and an inner collar disposed in spaced relationship relative to each other extending outwardly from an outer surface of said hinge plate that cooperatively form a housing and a tension adjustment assembly at least partially disposed within said housing to selectively adjust a bias disposed within said housing having a first adjustment assembly disposed at one end thereof and a second adjustment assembly disposed at the opposite end thereof to selectively adjust the force of said adjustable hinge from either end thereof, said first adjustment assembly and said second adjustment assembly each comprising an end cap and a hinge pin rotatably disposed relative to said end cap, each said outer collar including a centrally disposed longitudinal end cap receiving channel to receive at least a portion of the corresponding end cap therein and said inner collar including a centrally disposed longitudinal hinge pin receiving channel to receive at least a portion of the corresponding hinge pin therein, each said end cap comprising a body having a centrally disposed longitudinal channel formed therethrough and a first set of ratchet teeth is formed on an inner end portion of said body and each said hinge pin comprising a cap including a bias receiving recess and a pin receiving channel to receive portions of said adjustable bias and a second set of ratchet teeth formed on an outer end portion thereof to operatively engage said first set of ratchet teeth to cooperatively form a ratchet or hinge pin directional control to control the direction of rotation of said hinge pin relative to said end cap.

2. The adjustable hinge of claim 1 wherein a tool receiving projection including a tool receiving channel extends outwardly from the outer end portion of each said cap to selectively receive a tool to rotate one or the other of said hinge pins to selectively increase or decrease the tension of said adjustable bias.

3. The adjustable hinge of claim 2 wherein each said end cap is secured within said centrally disposed longitudinal end cap receiving channel of the corresponding outer collar by a corresponding pin fitted through a channel formed through the side of said corresponding outer collar and seated in a recess formed in the corresponding end cap.

4. The adjustable hinge of claim 2 wherein said adjustable bias comprises a helical or torsion spring disposed within said bias receiving recess formed in each hinge pin having a pin extending outwardly from each end thereof to fit into the corresponding pin receiving channel formed in each said hinge pin to secure helical or torsion spring of said adjustable bias rotationally relative to said cap of the corresponding hinge pin.

5. The adjustable hinge of claim 1 wherein each tooth of the second set of ratchet teeth of said hinge pin includes a leading face or surface inclined or slanted in a first or rearwardly relative to the direction of rotation of said hinge pin when increasing tension or torque of the helical or torsion spring; while, each tooth of the first set of ratchet teeth of each said end cap includes a trailing face or surface that may be inclined or slanted in a second direction such that when said hinge pin is rotated in a first direction said teeth of the second set of ratchet teeth glide or slip past said teeth of said first set of ratchet teeth twisting said helical or torsion spring increasing the tension on said helical or torsion spring to increase the closing force of said adjustable hinge.

6. The adjustable hinge of claim 5 wherein said leading faces or edges of said first set of ratchet teeth engage said trailing faces or edges of said second set of ratchet teeth to prevent reverse rotation of said hinge pin to secure said hinge pin of said upper adjustment assembly in position.

7. The adjustable hinge of claim 6 wherein said first set of ratchet teeth and said second set of ratchet teeth of said adjustment member allow rotational movement of said upper hinge pin of said adjustment member in one direction only and wherein the spring tension is released when said hinge pin is depressed disengaging said second set of ratchet teeth from said first set of ratchet teeth allowing said upper hinge pin to rotate causing the helical or torsion spring to return to the original position.

8. The adjustable hinge of claim 1 wherein said teeth of said first set of ratchet teeth and said teeth of the second set of ratchet are sized relative to each other to permit either of said hinge pins to be incrementally rotated or ratcheted in said first direction to increase the tension of said corresponding helical or torsion spring or incrementally ratcheted in a second direction to decrease the tension or said helical or torsion spring tension.

9. The adjustable hinge of claim 8 wherein said teeth of said first set of ratchet teeth and said teeth of the second set of ratchet are shaped relative to each other to permit either of said hinge pins to be incrementally rotated or ratcheted in said first direction to increase the tension of said corresponding helical or torsion spring or incrementally ratcheted in a second direction to decrease the tension or said helical or torsion spring tension.

10. The adjustable hinge of claim 1 wherein said teeth of said first set of ratchet teeth and said teeth of the second set of ratchet are shaped relative to each other to permit either of said hinge pins to be incrementally rotated or ratcheted in said first direction to increase the tension of said corresponding helical or torsion spring or incrementally ratcheted in a second direction to decrease the tension or said helical or torsion spring tension.

11. The adjustable hinge of claim 1 wherein said teeth of said first set of ratchet teeth and said teeth of the second set of ratchet are substantially the same size relative to each other to permit either of said hinge pins to be incrementally rotated or ratcheted in said first direction to increase the tension of said corresponding helical or torsion spring or incrementally ratcheted in a second direction to decrease the tension or said helical or torsion spring tension.

12. The adjustable hinge of claim 11 wherein said teeth of said first set of ratchet teeth and said teeth of the second set of ratchet are substantially the same shape relative to each other to permit either of said hinge pins to be incrementally rotated or ratcheted in said first direction to increase the tension of said corresponding helical or torsion spring or incrementally ratcheted in a second direction to decrease the tension or said helical or torsion spring tension.

13. The adjustable hinge of claim 1 wherein said teeth of said first set of ratchet teeth and said teeth of the second set of ratchet are substantially the same shape relative to each other to permit either of said hinge pins to be incrementally rotated or ratcheted in said first direction to increase the tension of said corresponding helical or torsion spring or incrementally ratcheted in a second direction to decrease the tension or said helical or torsion spring tension.

14. An adjustable hinge for a door or gate comprising a first hinge member and a second hinge member rotatable relative to each other, said first hinge member and said second hinge member each comprising a hinge plate having an outer collar and an inner collar disposed in spaced relationship relative to each other extending outwardly from an outer surface of said hinge plate that cooperatively form a housing and a tension adjustment assembly at least partially disposed within said housing to selectively adjust a bias disposed within said housing having a first adjustment assembly disposed at one end thereof and a second adjustment assembly disposed at the opposite end thereof to adjust the force of said adjustable hinge from either end thereof, said first adjustment assembly and said second adjustment assembly each comprising an end cap and a hinge pin rotatably disposed relative to said end cap each said outer collar including a centrally disposed longitudinal end cap receiving channel to receive at least a portion of the corresponding end cap therein and said inner collar including a centrally disposed longitudinal hinge pin receiving channel to receive at least a portion of the corresponding hinge pin therein extending or projecting outwardly from the front face or surface of said hinge plate, said inner collar of said first hinge member is at least partially disposed between said outer collar and said inner collar of said second hinge member and said inner collar of said second hinge member is at least partially disposed between said outer collar and said inner collar of said first hinge member cooperatively from said housing for said first adjustment assembly, said second adjustment assembly and said adjustable bias when said outer collars and said inner collars are axially aligned when said adjustable hinge is assembled wherein each end cap comprises a body having a centrally disposed longitudinal channel formed therethrough and a first set of ratchet teeth is formed on an inner end portion of said body and each said hinge pin comprises a cap including a bias receiving recess and a pin receiving channel to receive portions of said adjustable bias and a second set of ratchet teeth formed on an outer end portion thereof to operatively engage said first set of ratchet teeth to cooperatively form a ratchet or hinge pin directional control to control the direction of rotation of said hinge pin relative to said end cap.

15. The adjustable hinge of claim 14 wherein an outer end portion of said body has an inclined or slanted surface and an end portion of each said outer collar has an inclined or slanted surface adjacent said inclined or slanted surface of the corresponding body of the corresponding end cap in substantially the same diagonal plane.

16. An adjustable hinge for a door or gate comprising a first hinge member and a second hinge member rotatable relative to each other, said first hinge member and said second hinge member each comprising a hinge plate having an outer collar and an inner collar disposed in spaced relationship relative to each other extending outwardly from an outer surface of said hinge plate that cooperatively form a housing and a tension adjustment assembly at least partially disposed within said housing to selectively adjust a bias disposed within said housing having a first adjustment assembly disposed at one end thereof and a second adjustment assembly disposed at the opposite end thereof to adjust the force of said adjustable hinge from either end thereof, said first adjustment assembly and said second adjustment assembly each comprising an end cap and a hinge pin rotatably disposed relative to said end cap, each said outer collar including a centrally disposed longitudinal end cap receiving channel to receive at least a portion of the corresponding end cap therein and said inner collar including a centrally disposed longitudinal hinge pin receiving channel to receive at least a portion of the corresponding hinge pin therein, said inner collar of said first hinge member being at least partially disposed between said outer collar and said inner collar of said second hinge member and said inner collar of said second hinge member being at least partially disposed between said outer collar and said inner collar of said first hinge member to cooperatively form said housing for said first adjustment assembly, said second adjustment assembly and said adjustable bias when said outer collars and said inner collars are axially aligned when said hinge is assembled and further including a floating spacer having said adjustable bias at least partially disposed therein slidably disposed between said caps of said hinge pins within said housing cooperatively formed by said outer collars and said inner collars to overlap the crease or seam between said two inner collars such that said end caps, said caps, said hinge pins and said floating spacer substantially isolate the interior of said housing from the exterior environs protecting said adjustable bias from the surrounding elements.

17. An adjustable hinge for a door or gate comprising a first hinge member and a second hinge member rotatable relative to each other, said first hinge member and said second hinge member each comprising a hinge plate having an outer collar and an inner collar disposed in spaced relationship relative to each other extending outwardly from an outer surface of said hinge plate that cooperatively form a housing and a tension adjustment assembly at least partially disposed within said housing to selectively adjust a bias disposed within said housing having a first adjustment assembly disposed at one end thereof and a second adjustment assembly disposed at the opposite end thereof to adjust the force of said adjustable hinge from either end thereof, said first adjustment assembly and said second adjustment assembly each comprising an end cap and a hinge pin rotatably disposed relative to said end cap each said outer collar including a centrally disposed longitudinal end cap receiving channel to receive at least a portion of the corresponding end cap therein and said inner collar including a centrally disposed longitudinal hinge pin receiving channel to receive at least a portion of the corresponding hinge pin therein wherein each end cap comprises a body having a centrally disposed longitudinal channel formed therethrough and at least one tooth is formed on the inner end portion of said body and each said hinge pin comprises a cap including a bias receiving recess and a pin receiving channel to receive portions of said adjustable bias and a second set of ratchet teeth formed on the outer end portion thereof to operatively engage said tooth to cooperatively form a ratchet or hinge pin directional control to control the direction of rotation of said hinge pin relative to said end cap.

18. An adjustable hinge for a door or gate comprising a first hinge member and a second hinge member rotatable relative to each other, said first hinge member and said second hinge member each comprising a hinge plate having an outer collar and an inner collar disposed in spaced relationship relative to each other extending outwardly from an outer surface of said hinge plate that cooperatively form a housing and a tension adjustment assembly at least partially disposed within said housing to selectively adjust a bias disposed within said housing having a first adjustment assembly disposed at one end thereof and a second adjustment assembly disposed at the opposite end thereof to adjust the force of said adjustable hinge from either end thereof, said first adjustment assembly and said second adjustment assembly each comprises an end cap and a hinge pin rotatably disposed relative to said end cap, each said outer collar, each hinge member comprises a hinge plate having an outer collar including a centrally disposed longitudinal end cap receiving channel to receive at least a portion of the corresponding end cap therein and said inner collar including a centrally disposed longitudinal hinge pin receiving channel to receive at least a portion of the corresponding hinge pin therein, said inner collar of said first hinge member being at least partially disposed between said outer collar and said inner collar of said second hinge member and said inner collar of said second hinge member being at least partially disposed between said outer collar and said inner collar of said first hinge member to cooperatively form said housing for said first adjustment assembly, said second adjustment assembly and said adjustable bias when said outer collars and said inner collars are axially aligned when said hinge is assembled and further including an axial alignment hollow sleeve slidably disposed between said hinge pins within said housing disposed to engage adjacent inner ends of said inner to maintain axial alignment between said inner and said outer collars.

19. The adjustable hinge of claim 18 wherein said end caps, said caps, said hinge pins and said axial alignment hollow sleeve substantially isolate the interior of said housing from the exterior environs protecting said bias from the surrounding elements.

20. An adjustable hinge for a door or gate comprising a first hinge member and a second hinge member rotatable relative to each other, said first hinge member and said second hinge member each comprising a hinge plate having an outer collar and an inner collar disposed in spaced relationship relative to each other extending outwardly from an outer surface of said hinge plate that cooperatively form a housing and a tension adjustment assembly at least partially disposed within said housing to selectively adjust a bias disposed within said housing having a first adjustment assembly disposed at one end thereof and a second adjustment assembly disposed at the opposite end thereof to adjust the force of said adjustable hinge from either end thereof, said first adjustment assembly and said second adjustment assembly each comprising an end cap and a hinge pin rotatably disposed relative to said end cap wherein each said end cap comprises a body having a centrally disposed longitudinal channel formed therethrough and a first set of ratchet teeth is formed on the inner end portion of said body and each said hinge pin comprises a cap including a bias receiving recess and a pin receiving channel to receive portions of said adjustable bias and a second set of ratchet teeth formed on the outer end portion thereof to operatively engage said first set of ratchet teeth to cooperatively form a ratchet or hinge pin directional control to control the direction of rotation of said hinge pin relative to said end cap.

21. An adjustable hinge for a door or gate comprising a first hinge member and a second hinge member rotatable relative to each other, said first hinge member and said second hinge member each comprising a hinge plate having an outer collar and an inner collar disposed in spaced relationship relative to each other extending outwardly from an outer surface of said hinge plate that cooperatively form a housing and a tension adjustment assembly at least partially disposed within said housing to selectively adjust a bias disposed within said housing having a first adjustment assembly disposed at one end thereof and a second adjustment assembly disposed at the opposite end thereof to selectively adjust the force of said adjustable hinge from either end thereof and an axial alignment hollow sleeve slidably disposed within said housing disposed engage the adjacent inner ends of said inner collars to maintain axial alignment between said inner collars and said outer collars.

22. An adjustable hinge for a door or gate comprising a first hinge member and a second hinge member rotatable relative to each other, said first hinge member and said second hinge member each comprising a hinge plate having an outer collar and an inner collar disposed in spaced relationship relative to each other extending outwardly from an outer surface of said hinge plate that cooperatively form a housing and a tension adjustment assembly at least partially disposed within said housing to selectively adjust a bias disposed within said housing having a first adjustment assembly disposed at one end thereof and a second adjustment assembly disposed at the opposite end thereof to selectively adjust the force of said adjustable hinge from either end thereof and a floating spacer having said adjustable bias at least partially disposed therein slidably disposed within said housing cooperatively formed by said outer collars and said inner or interior collars to overlap the crease or seam between said two inner collars to substantially isolate the interior of said housing from the exterior environs protecting said adjustable bias from the surrounding elements.

* * * * *